US009725279B2

(12) United States Patent
Armistead

(10) Patent No.: US 9,725,279 B2
(45) Date of Patent: Aug. 8, 2017

(54) ELEVATOR TRAFFIC MONITORING SYSTEM AND METHOD

(75) Inventor: Jason R. Armistead, Avon, CT (US)

(73) Assignee: OTIS ELEVATOR COMPANY, Farmington, CT (US)

( * ) Notice: Subject to any disclaimer, the term of this patent is extended or adjusted under 35 U.S.C. 154(b) by 416 days.

(21) Appl. No.: 14/378,437

(22) PCT Filed: Feb. 28, 2012

(86) PCT No.: PCT/US2012/026867

§ 371 (c)(1),
(2), (4) Date: Aug. 13, 2014

(87) PCT Pub. No.: WO2013/130040

PCT Pub. Date: Sep. 6, 2013

(65) Prior Publication Data

US 2015/0034426 A1 Feb. 5, 2015

(51) Int. Cl.

| | |
|---|---|
| ***B66B 1/34*** | (2006.01) |
| ***B66B 19/00*** | (2006.01) |
| ***B66B 5/00*** | (2006.01) |

(52) U.S. Cl.

CPC ..... *B66B 1/3476* (2013.01); *B66B 5/0012* (2013.01); *B66B 5/0037* (2013.01); *B66B 19/007* (2013.01)

(58) Field of Classification Search

CPC ... B66B 1/3476; B66B 5/0012; B66B 5/0037; B66B 19/007; B66B 2201/304; B66B 2201/401; B66B 2201/402; B66B 2201/403

USPC ..... 187/247, 380–388, 391, 392, 393, 396

See application file for complete search history.

(56) References Cited

U.S. PATENT DOCUMENTS

| | | | | |
|---|---|---|---|---|
| 4,874,063 | A | 10/1989 | Taylor | |
| 6,109,396 | A * | 8/2000 | Sirag | B66B 1/468 187/381 |
| 6,202,799 | B1 * | 3/2001 | Drop | B66B 1/468 187/384 |
| 6,209,685 | B1 | 4/2001 | Zaharia et al. | |
| 6,615,175 | B1 | 9/2003 | Gazdzinski | |
| 6,772,862 | B2 * | 8/2004 | Friedli | B66B 1/2458 187/247 |

(Continued)

FOREIGN PATENT DOCUMENTS

| | | | |
|---|---|---|---|
| CN | 101054140 | A | 10/2007 |
| CN | 102190221 | A | 9/2011 |

(Continued)

OTHER PUBLICATIONS

Extended European Search Report for European Application No. 12870188.5, received Oct. 7, 2015.

(Continued)

*Primary Examiner* — Anthony Salata
(74) *Attorney, Agent, or Firm* — Carlson, Gaskey & Olds

(57) ABSTRACT

An exemplary method includes distributing identifying tags to a plurality of potential elevator passengers so that each passenger has a uniquely identifiable one of the tags. Collective elevator system traffic information is determined based on monitoring movement of individual ones of the plurality of tags and corresponding elevator system operation.

20 Claims, 1 Drawing Sheet

(56) References Cited

U.S. PATENT DOCUMENTS

| | | | | |
|---|---|---|---|---|
| 7,083,027 | B2 * | 8/2006 | Siikonen | B66B 1/2458 187/383 |
| 7,729,691 | B2 * | 6/2010 | Newville | G06Q 30/0207 187/247 |
| 7,823,700 | B2 | 11/2010 | Boss et al. | |
| 8,061,485 | B2 * | 11/2011 | Finschi | B66B 1/468 187/384 |
| 8,646,581 | B2 * | 2/2014 | Iwata | B66B 1/468 187/387 |
| 8,710,955 | B2 * | 4/2014 | Teti | G07C 9/00158 187/313 |
| 8,905,195 | B2 * | 12/2014 | Finschi | B66B 1/2458 187/249 |
| 9,323,232 | B2 * | 4/2016 | Blom | G05B 13/00 |
| 9,382,095 | B2 * | 7/2016 | Rusanen | B66B 1/468 |
| 2004/0169589 | A1 | 9/2004 | Lea et al. | |
| 2007/0295565 | A1 | 12/2007 | Roydhouse | |
| 2009/0022131 | A1 | 1/2009 | Rusanen et al. | |
| 2009/0208067 | A1 | 8/2009 | Peng et al. | |
| 2011/0121074 | A1 | 5/2011 | Makimattila | |
| 2012/0037458 | A1 | 2/2012 | Gerstenkorn | |
| 2014/0231185 | A1 * | 8/2014 | Salmikuukka | B66B 1/2458 187/384 |
| 2015/0329316 | A1 * | 11/2015 | Lee | B66B 1/2408 187/384 |

FOREIGN PATENT DOCUMENTS

| | | | |
|---|---|---|---|
| CN | 102275786 | A | 12/2011 |
| JP | S57121569 | A | 7/1982 |
| JP | S59149280 | A | 8/1984 |
| JP | 2010006613 | | 1/2010 |
| JP | 2012035984 | A | 2/2012 |
| KR | 100991477 | B1 | 11/2010 |
| WO | 2009122002 | | 10/2009 |

OTHER PUBLICATIONS

State Intellectual Property Office of People's Republic China, First Search, Chinese Application No. 201280070870.5 dated Mar. 9, 2015.

International Preliminary Report on Patentability for International application No. PCT/US2012/026887 dated Sep. 12, 2014.

International Search Report and Written Opinion of the International Searching Authority for International application No. PCT/US2012/026867 dated Feb. 25, 2013.

* cited by examiner

ELEVATOR TRAFFIC MONITORING SYSTEM AND METHOD

BACKGROUND

Elevator systems are known to include one or more elevator cars servicing the various floors of a building. An understanding of passenger traffic, including passenger traffic patterns, within an elevator system may be useful when making determinations regarding car allocation, among other things. Another use for elevator traffic information is planning a modernization that will introduce destination entry features into an elevator system that currently only has traditional hall call buttons.

Passenger traffic information is typically gathered manually by a designated individual that rides an elevator car for a certain period of time, during which the individual records observed information. One problem with this approach is that elevator passengers often become uncomfortable when they notice an individual observing them as they use the elevator system. Another drawback is that it is labor intensive.

Alternatively, generic data loggers or load weighing mechanisms can be associated with individual cars to gather information corresponding to elevator usage. One such approach is disclosed in U.S. Pat. No. 4,874,063. One shortcoming of previously proposed automated arrangements is that they are not capable of tracking traffic patterns of individual passengers. Therefore, only limited information is available, which does not facilitate selecting a best-fit modernization.

SUMMARY

An exemplary method includes distributing identifying tags to a plurality of potential elevator passengers so that each passenger has a uniquely identifiable one of the tags. Collective elevator system traffic information is determined based on monitored movement of each of the plurality of tags and corresponding elevator system operation.

An exemplary system includes identifying tags configured to be distributed to a plurality of potential elevator passengers so that each passenger has a uniquely identifiable one of the tags. A controller is configured to determine collective elevator system traffic information based on monitored movement of individual ones of the plurality of tags and corresponding elevator system operation.

These and other features of a disclosed example can be best understood from the following drawings and detailed description.

BRIEF DESCRIPTION OF THE DRAWINGS

The drawings can be briefly described as follows.

DETAILED DESCRIPTION

Figure 1:
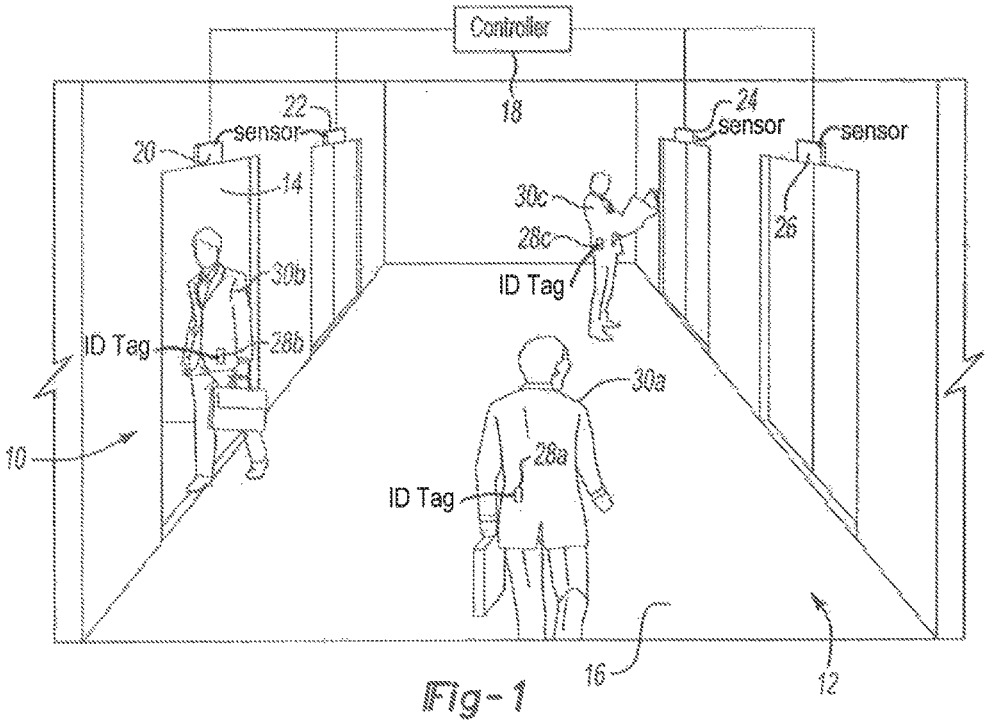
FIG. 1 schematically illustrates an example elevator traffic monitoring system.

FIG. 1 schematically illustrates an example elevator traffic pattern monitoring system 10. An elevator system 12 includes a plurality of elevator cars 14 providing access to the various floors of a building, one of which is shown at 16. In the example shown, four elevator cars service the floor 16.

Four cars are illustrated for discussion purposes, and embodiments of this invention are not necessarily limited to any number of cars or floors.

The disclosed elevator traffic pattern monitoring system 10 includes a controller 18 in communication with a plurality of detectors 20, 22, 24, 26, which are generally operable to detect the presence of an identifying tag (ID tag) 28 that is carried about by an elevator passenger 30. The detectors 20-26 in one example are temporarily installed for purposes of conducting a survey of elevator traffic. In another example, the detectors are permanent fixtures associated with the elevator system 12.

Every floor 16 within a particular building may include a separate set of detectors 20, 22, 24, 26 associated with each elevator car. The detectors 20, 22, 24, 26 may be positioned above a car entrance as shown in FIG. 1 or below the entrance, as examples. In other examples, the detectors may be mounted inside the elevator cars such that the detectors travel with the cars. In either case, the system 10 is operable to correlate information from the detectors to a particular building and car location and corresponding elevator system operation information to accurately monitor the movement of the ID tags 28*a-c*.

In one example, the controller 18 comprises a computing device configured to log various types of information (e.g., time and location information) in response to a detection of the ID tags 28*a-c* by the detectors 20, 22, 24, 26. In general, the controller 18 is capable of receiving information, storing information, compiling information and generating various reports. The example controller 18 is capable of being further modified to make determinations based on stored information and to provide actionable instructions to certain portions of the traffic monitoring system 10.

While a single, central controller 18 is shown in communication with each of the detectors 20, 22, 24, 26, the detectors within the system 10 may each include separate controllers. In that case, the detectors 20, 22, 24, 26 would be operative to log location and time information themselves. That logged data can be later collected (by another controller, for example) for compiling and determining the elevator system traffic information.

Figure 2:
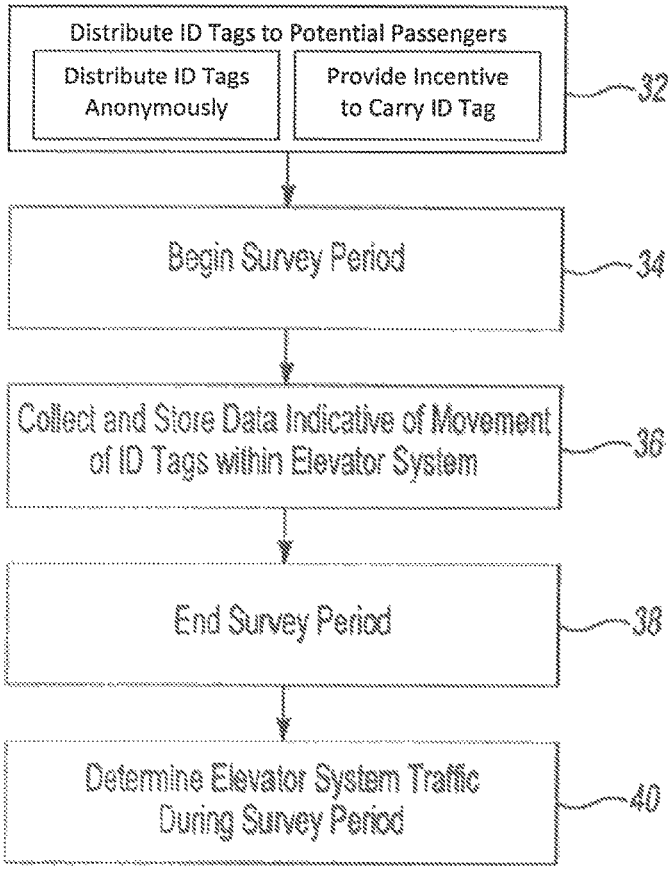
FIG. 2 is a flowchart diagram summarizing an example approach for monitoring elevator system traffic.

One example approach is summarized in the flowchart diagram of FIG. 2. At 32, ID tags 28 are distributed to each of a plurality of potential elevator passengers 30. In one example, each individual ID tag 28 is unique and distinguishable from the remaining ID tags 28 (e.g., ID tag 28*a* a is uniquely identifiable and distinguishable from ID tags 28*b* and 28*c*). While only three ID tags 28*a-c* and passengers 30*a-c* are shown in FIG. 1, there may be any number of passengers involved in the disclosed elevator monitoring system 10, with each passenger carrying a respective, unique ID tag. These passengers 30*a-c* may be persons expected to use the elevator system 12 on a regular basis, such as individuals that live or are employed within a building including the elevator system 12.

To retain the privacy of the elevator passengers 30*a-c*, the identifying tags 28*a-c* are distributed anonymously such that the identity of the particular elevator passenger 30*a-c* is not associated with the corresponding identifying tag 28*a-c* assigned to that passenger 30*a-c*. Other precautionary measures may be employed to protect the identities of the elevator passengers 30, if needed. At the same time, however, movement of each of the ID tags can be individually monitored in a manner that provides enhanced traffic information.

One example includes providing an incentive to passengers to carry an ID tag by offering rewards (e.g., giving each participant a prize, or entering each participant into a drawing for a prize) in exchange for the passenger agreeing to carry the ID tag. This reward may be awarded when a passenger 30*a-c* agrees to carry the ID tag, or following return of the ID tags after a certain amount of time (e.g., after a survey period).

One example includes monitoring elevator system traffic based on movement of the tags 28 during a survey period of a number of days, a week, or a month, as examples. The monitoring period begins at 34 in FIG. 2 after a desired number of ID tags 28 have been distributed to passengers 30.

Once the survey period begins, at 34, data indicative of the movement of each uniquely identifiable ID tag 28 within the elevator system 12 is collected and stored at 36. By virtue of the ID tags 28*a-c* being carried by a number of the passengers 30*a-c*, monitoring the location and movement of the ID tags 28*a-c* within the elevator system 12 and associating that with information regarding corresponding operation of the elevator system provides accurate, detailed and collective elevator traffic information. The traffic information provides an indication of individual passenger movement and elevator operation. Such information is useful when determining elevator car allocation strategies for particular instances such as peak hours, for selecting an appropriate elevator modernization approach or for otherwise gauging the effectiveness and efficiency of the elevator system 12.

For example, as the passenger 30*b* boards or exits the elevator car 14, the detector 20 detects the presence of the particular ID tag 28*b*. Upon initial detection of the ID tag, the detector alerts the controller 18, which in turn logs the location information and the corresponding time. Information regarding elevator system information is associated with the time and location information regarding the monitored tag. For example, if a detector provides an indication that a tag is leaving an elevator car, the controller 18 associates that with information regarding recent travel of the corresponding elevator car such as recent departure floors. When the same ID tag was detected entering the elevator car, the location at which that was detected is determined as the departure floor for that trip of that passenger.

The movement of each of the uniquely identifiable ID tags 28 is monitored and stored so that individual passenger information is available for later analysis, which provides better information than merely counting passengers or estimating loads on elevator cars. With the disclosed example, it is possible to monitor individual passenger traffic patterns without presenting any privacy concerns for any of the passengers because the individual ID tags 28 need not be correlated with any identity information of any of the passengers 30.

Additionally, the information regarding a particular passenger can be monitored over time to determine a traffic history or pattern for that individual. All detections and associated movements of the same ID tag are correlated by the controller 18 to establish a traffic history of that passenger during the survey period in one example. Such information together with collective elevator system traffic information allows for strategically configuring an elevator system modernization or to modify an existing control strategy, for example. The individual passenger information provides additional insight into the use of the elevator system that goes beyond generic information regarding total load or total number of trips that an elevator car or system experiences, for example. The particulars of the elevator system operation information and the manner in which it is associated with ID tag movement may depend on the needs of a particular situation. Given this description those skilled in the art will be able to determine what meets their particular needs.

In addition to monitoring elevator travel of individual passengers, the disclosed example allows for grouping individuals based on their reasons for being in a building. For example, in a multi-tenant building the ID tags given to individuals that are members of the same organization or employees of the same company (i.e., the same tenant) can be associated with each other in a database. This approach allows for determining elevator travel of each individual and elevator travel of the tenant collectively. Considering individual passengers and groups of passengers having some relationship makes it is possible to distinguish elevator travel of the primary occupants of certain floors of a building from casual, or secondary, travelers (e.g., couriers, building management). It also allows for comparing elevator traffic patterns of different tenants or groups of people. In this example, even though the ID tags are recognizable as having been given to an individual that is part of a group the individual identity of the individual can still be transparent to the system so that it sufficiently protects the identity of the particular elevator passengers 30*a-c*.

The collection and storage of data continues until the end of the survey period, at 38. Accordingly, data indicative of the movement of each of the individual tags 28*a-c* during the survey period is collected. This data, when compiled together, is representative of the overall or collective elevator system 12 traffic. Specifically, when compiling the data regarding one tag (e.g., ID tag 28*a*) with one or more others (e.g., ID tag 28*b*), collective traffic information within the elevator system 12 can be determined, and traffic patterns can be identified. Compiling information from a larger number of tags increases the amount of information and the accuracy of the determined traffic information.

After the survey period, the stored information is compiled, at 40, and used to generate an elevator system traffic report. The elevator system traffic report may be customized by a user to represent traffic patterns within the elevator system 12, and to allow the user to focus on specific information. It is possible to compile the stored information, and to generate reports, prior to the end of the survey period. In one example, multiple reports are configured to track movement of the ID tags 28*a-c* in real time.

In one example, the detectors 20, 22, 24, 26 are radio frequency identification (RFID) detectors and the ID tags 28*a-c* are RFID tags. One feature of known RFID technology is that it allows for inexpensive ID tags to be distributed without concern over passengers losing or failing to return them at the end of the survey period. In another example, the ID tags comprise wireless signaling devices or transmitters that transmit short range wireless communication signals. In one such example the detectors 20, 22, 24, 26 and ID tags 28*a-c* comprise known BLUETOOTH® devices. Another example includes ID tags and detectors that utilize known picocell technology (e.g., an access point is configured to detect the presence of an identifiable communication device that is authorized to communicate with that access point). Another example includes a wireless fidelity (Wi-Fi) network to track unique MAC addresses associated with each ID tag 28*a-c*. In the example of FIG. 1, the detectors 20, 22, 24, 26 are positioned above the entrance to each elevator car 14 and within the hallway of the floor 16. The detectors 20, 22, 24, 26 may be essentially tuned to avoid faulty ID tag 28*a-c* detection. That is, when a passenger enters or exits the car 14, for example, only the detector 20 detects the ID tag

28*a-c*. If a faulty detection occurs (e.g., detector 22 also detects the ID tag 28*a-c*) other data associated with the particular ID tag 28*a-c* may be used to identify and correct the error.

The disclosed example provides the ability to obtain collective elevator traffic information that is based on individual passenger movement. The collective information provides an indication of use of the entire elevator system and individual passenger traffic patterns.

One of ordinary skill in this art will understand that the above-described embodiments are exemplary and non-limiting. That is, modifications of this disclosure would come within the scope of the claims. Accordingly, the following claims should be studied to determine their true scope and content.

I claim:

1. A method comprising the steps of:

distributing identifying tags to a plurality of potential elevator passengers such that each passenger has a uniquely identifiable one of the tags, wherein at least some of the identifying tags are associated with each other based on some relationship between the passengers having the associated identifying tags;

monitoring movement of a plurality of the tags; and determining collective elevator system traffic information based on the monitored movement of individual ones of the plurality of tags and corresponding elevator system operation.

2. The method of claim 1, comprising monitoring the movement during a survey period, and determining the elevator system traffic after at least a portion of the survey period is complete.

3. The method of claim 2, comprising compiling information regarding the movement of a plurality of the tags collected during the survey period.

4. The method of claim 1, wherein the step of monitoring movement includes collecting location information indicative of a location of each of the monitored tags within the elevator system, and associating the location information with collected time information.

5. The method of claim 4, wherein the location information is gathered by a plurality of detectors in communication with a controller.

6. The method of claim 5, comprising discriminating between the time and location information for each of the uniquely identifiable tags that are monitored and maintaining anonymity for each passenger corresponding to each monitored tag.

7. The method of claim 5, wherein the elevator system includes a plurality of elevator cars, and comprising positioning at least one of the detectors that is configured to detect any of the tags in a vicinity of each of the elevator cars, the detectors providing an indication when any of the tags enters or exits a corresponding one of the elevator cars.

8. The method of claim 1, comprising offering an incentive to each of the plurality of potential passengers to carry one of the tags.

9. The method of claim 1, wherein distributing step includes anonymously distributing the tags to the plurality of potential elevator passengers to protect the identities of the potential elevator passengers.

10. The method of claim 1, wherein the tags comprise at least one of radio-frequency identification (RFID) tags and mobile devices configured to exchange data over short distances using short range radio transmissions.

11. An elevator traffic monitoring system, comprising:

a plurality of identifying tags configured to be distributed to a plurality of potential elevator passengers such that each of the elevator passengers has a uniquely identifiable one of the tags wherein at least some of the identifying tags are associated with each other based on some relationship between the passengers having the associated identifying tags; and a controller configured to determine collective elevator system traffic information based on monitored movement of individual ones of the plurality of tags and corresponding elevator system operation.

12. The system of claim 11, including a plurality of detectors configured to detect any of the tags, the detectors communicating information to the controller indicating when a detected tag enters or exits an elevator car, the controller being configured to associate the detected tag information with elevator system operation information corresponding to travel of the tags within the elevator system.

13. The system of claim 12, including a plurality of elevator cars, and wherein each of the elevator cars is associated with at least one of the detectors.

14. The system of claim 12, wherein the elevator system includes a plurality of the detectors positioned in each hallway where a passenger can access an elevator car of the elevator system.

15. The system of claim 11, wherein the tags comprise at least one of radio-frequency identification (RFID) tags and mobile devices configured to exchange data over short distances using short range radio transmissions.

16. The system of claim 11, wherein the relationship comprises being members of a group and the controller determines elevator traffic information of the group.

17. The system of claim 11, wherein the relationship comprises the passengers having the associated identifying tags being members of at least one of:

a group having a common reason for being in a building, an organization, a company, and a tenant in a building.

18. The system of claim 11, wherein the controller is configured to determine the collective elevator system traffic information including at least one of:

(i) determining elevator travel of each passenger individually and elevator travel of the passengers having the associated identifying tags collectively, (ii) distinguishing elevator travel of passengers that are primary occupants of at least one selected floor of a building from elevator travel of other types of passengers, and (iii) comparing elevator traffic patterns of different groups of passengers.

19. The method of claim 1, wherein the relationship comprises the passengers having the associated identifying tags being members of at least one of:

a group having a common reason for being in a building, an organization, a company, and a tenant in a building.

20. The method of claim 11, wherein determining collective elevator system traffic information comprises at least one of:

(i) determining elevator travel of each passenger individually and elevator travel of the passengers having the associated identifying tags collectively, (ii) distinguishing elevator travel of passengers that are primary occupants of at least one selected floor of a building from elevator travel of other types of passengers, and (iii) comparing elevator traffic patterns of different groups of passengers.

* * * * *